United States Patent [19]

Budzich

[11] 4,285,195

[45] Aug. 25, 1981

[54] LOAD RESPONSIVE CONTROL SYSTEM

[76] Inventor: Tadeusz Budzich, 80 Murwood Dr., Moreland Hills, Ohio 44022

[21] Appl. No.: 159,864

[22] Filed: Jun. 16, 1980

Related U.S. Application Data

[63] Continuation-in-part of Ser. No. 109,053, Jan. 2, 1980, and a continuation-in-part of Ser. No. 111,194, Jan. 11, 1980.

[51] Int. Cl.[3] ..... F15B 13/08

[52] U.S. Cl. ..... 60/450; 60/427; 60/452; 91/446; 91/448; 91/451; 137/596; 137/596.13

[58] Field of Search ..... 60/427, 450, 452; 91/446, 448, 451; 137/596, 569.13

[56] References Cited

U.S. PATENT DOCUMENTS

Re. 29,538 2/1978 Budzich ..... 91/446 X

*Primary Examiner*—Gerald A. Michalsky

[57] ABSTRACT

A load responsive fluid control system in which system pump controls permit variation in the level of pressure differential in response to an external control signal and which uses direction control valves equipped with load responsive variable pressure differential positive load controls.

20 Claims, 9 Drawing Figures

LOAD RESPONSIVE CONTROL SYSTEM

This is a continuation in part of application Ser. No. 109,053, filed Jan. 2, 1980 for "Load Responsive System Controls" and a continuation in part of application Ser. No. 111,194, filed Jan. 11, 1980, for "Load Responsive Fluid Control Valve".

BACKGROUND OF THE INVENTION

This invention relates generally to load responsive fluid control valves and to fluid power systems incorporating such valves, which systems are supplied by a single fixed or variable displacement pump, provided with a load responsive output flow control. Such control valves are equipped with an automatic load responsive control and can be used in a multiple load system, in which a plurality of loads is individually controlled under positive load conditions by separate control valves.

In more particular aspects this invention relates to a load responsive system using a load responsive pump control and load responsive individually compensated direction control valves, for control of positive loads, in which the controlled pressure differential, both of the load responsive pump control and load responsive valve controls, can be varied in response to external control signals.

Load responsive systems using load responsive pump control and individually compensated load responsive direction control valves are very desirable, since they provide high system efficiency, while permitting simultaneous proportional control of multiple positive loads. So far those systems have been based, both for the load responsive pump control and load responsive valve controls, on the principle of the constant pressure differential maintained across a controlling orifice. This principle, although effective, reduces to a degree system efficiency and the flexibility of the control.

SUMMARY OF THE INVENTION

It is therefore a principal object of this invention to provide an improved load responsive system, in which the level of the controlled pressure differential of load responsive system pump controls and of load responsive positive load valve controls can be varied in response to external control signals.

Another object of this invention is to provide a load responsive system supplied by a pump, equipped with load responsive control, in which the fluid flow through load responsive positive load direction control valves can be either controlled by variation in the area of flow orifice at a constant pressure differential, or by variation in level of the differential developed across flow orifice.

Briefly the foregoing and other additional objects and advantages of this invention are accomplished by providing novel load responsive controls of pump control and of a direction control valve, which can vary the level of pressure differential across a control orifice passing fluid flow to a load, automatically maintaining it constant at each selected level, in response to an external control signal, permitting optimization in the system control characteristics and system efficiency. Since the pressure differential across a variable control orifice can either be maintained constant, while varying the orifice area, or can be varied across control orifice at each specific area, a load responsive system control is provided with a dual control input, each input providing identical system performance. Therefore this control system lends itself very well to an application, in which one control input, say from an operator, can be modified by another control input say from an electric logic circuit or a micro-processor.

Additional objects of this invention will become apparent when referring to the preferred embodiments of the invention as shown in the accompanying drawings and described in the following detailed description.

DESCRIPTION OF THE PREFERRED EMBODIMENTS

Figure 1:
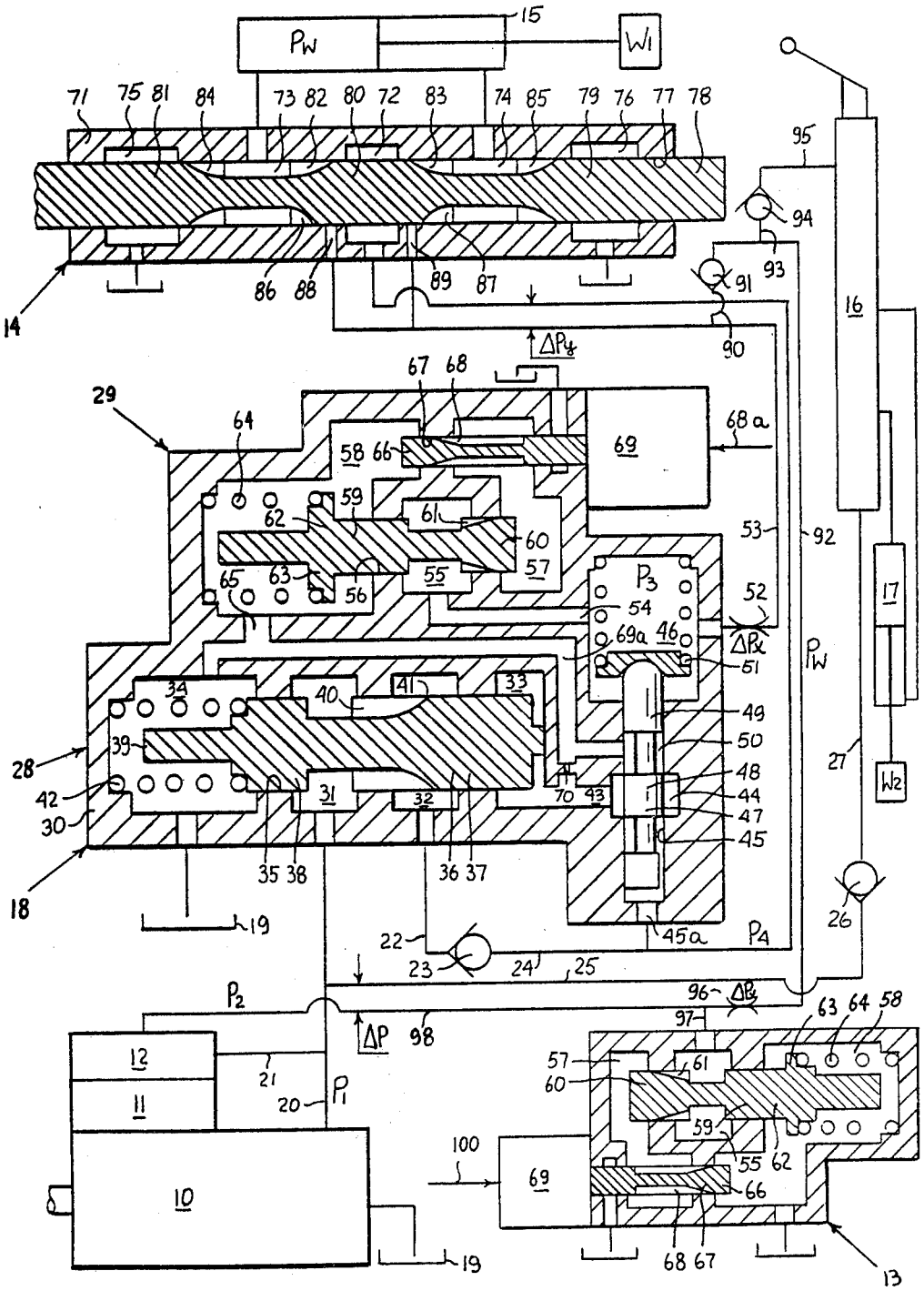
FIG. 1 is a diagrammatic representation of a load responsive control system showing variable pressure differential pump controls and positive load variable pressure differential valve controls with fluid motors, other load responsive valve, system pump, pump controls and system reservoir shown schematically.

Referring now to FIG. 1 the hydraulic system shown therein comprises a fluid pump 10, equipped with a flow changing mechanism 11, operated by an output flow control 12. The output flow control 12 regulates delivery of the pump 10 into a load responsive circuit composed of a differential control, generally designated as 13, regulating the level of pressure differential across a four way valve assembly, generally designated as 14, interposed between the pump 10 and a fluid motor 15 and a load responsive valve 16, interposed between the pump 10 and a fluid motor 17. The load responsive circuit of FIG. 1 also includes a differential throttling control, generally designated as 18, which throttles the fluid flow from the pump 10 to the four way valve assembly, generally designated as 14, to regulate the level of pressure differential developed across the four way valve assembly 14. The pump 10 may be of a fixed or variable displacement type and may respond to an external or internal control signal. With the pump 10 being of a fixed displacement type, the output flow control 12, in a well known manner, regulates, through flow changing mechanism 11, delivery from pump to load responsive circuit, by bypassing part of the pump flow to a system reservoir 19. With the pump 10 being of variable displacement type the output flow control 12, in a well known manner, regulates through flow changing mechanism 11 delivery from pump to load responsive circuit, by changing the pump displacement. Although in FIG. 1, for purposes of demonstration of the principle of the invention, the differential control 13 is shown separated, in actual application the differential control 13 would be most likely an integral part of pump output flow control 12. The output flow control 12 may be supplied with fluid energy from the pump 10 through discharge line 20 and line 21, or from a separate source of fluid energy. The pressurized fluid from the pump 10 is connected through discharge line 20, differential throttling control 18, line 22, load check 23 and line 24 with the four way valve assembly 14 and through line 25, load check 26 and line 27 with the load responsive valve 16.

The differential throttling control, generally designated as 18, composed of a throttling section, generally designated as 28 and a signal modifying section, generally designated as 29, comprises a housing 30 having an inlet chamber 31, an outlet chamber 32, a first control chamber 33 and an exhaust chamber 34, all of those chambers being connected by bore 35, slidably guiding a throttling spool 36. The throttling spool 36, equipped with lands 37 and 38 and stop 39, is provided with throttling slots 40, terminating in the cut-off edges 41, between the inlet chamber 31 and the outlet chamber 32. One end of the throttling spool 36 projects into the first control chamber 33, while the other end projects into the exhaust chamber 34 and is biased by a control spring 42. The first control chamber 33 is connected by passage 43 with annular space 44. Bore 45 connects annular space 44 with port **45*a* and a second control chamber 46 and axially guides a pilot valve spool 47. The pilot valve spool 47, equipped with a metering land 48 and land 49, which defines annular space 50, communicates with port 45*a* and projects into the second control chamber 46, where it engages a spring 51. The second control chamber 46 is connected through orifice 52 and line 53 to four way valve assembly 14 and is also connected through port 54 with the supply chamber 55, connected by bore 56 with a third control chamber 57 and an exhaust chamber 58. Bore 56 slidably guides a control spool 59, equipped with land 60, provided with throttling slots 61 and positioned between the supply chamber 55 and the third control chamber 57, a land 62 separating the supply chamber 55 and the exhaust chamber 58 and a flange 63. A spring 64 is interposed in the exhaust chamber 58 between the flange 63 of the control spool 59 and the housing 30. The exhaust chamber 58 connected by passage 65 with the exhaust chamber 34 and the third control chamber 57 are selectively interconnected by metering orifice created by a stem 66 guided in bore 67 and provided with metering slots 68. The stem 66 is connected to an actuator 69 responsive to an external control signal 68*a*. Exhaust chambers 58 and 34 connected by passage 65 are also connected by passage 69*a* with annular space 50 and leakage orifice 70. The four way valve assembly, generally designated as 14, comprises a housing 71 having a supply chamber 72, load chambers 73 and 74 and exhaust chambers 75 and 76, interconnected by bore 77, guiding a valve spool 78. The valve spool 78 is provided with lands 79, 80 and 81, throttling slots 82, 83, 84 and 85 and signal slots 86 and 87. The housing 71 is also provided with load sensing ports 88 and 89, communicating through line 53 and orifice 52 to the second control chamber 46, of the differential throttling control 18. Line 53 is also connected by line 90 and check valve 91 to signal line 92, which is also connected by line 93, check valve 94 and line 95 to load sensing ports of load responsive valve 16. Signal line 92 also communicates through orifice 96 and line 97 with the differential control 13. Down stream of orifice 96 is connected by line 98 with the flow control 12 of the pump 10. Construction of the differential control 13 is identical to that of the signal modifying section, generally designated as 29, of the differential throttling control 18, the same components being designated by the same numerals. A housing 99 of the differential control 13 mounts actuator 69 responsive to an external control signal 100**.

Figure 2:
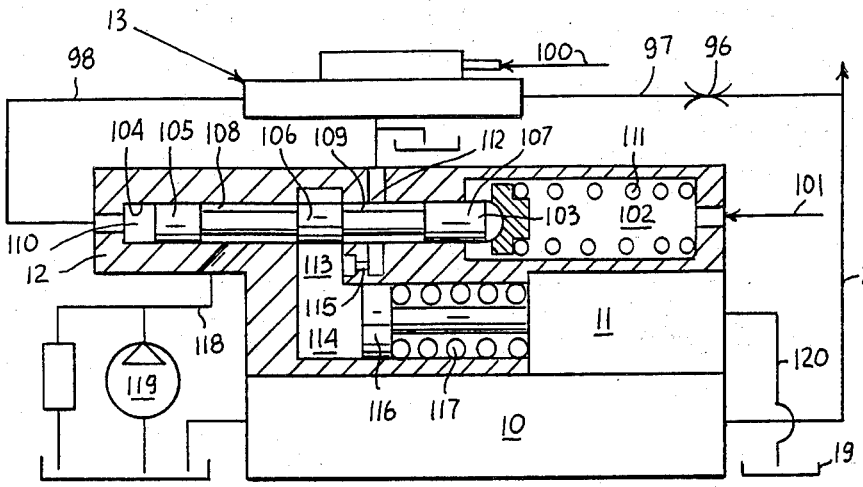
FIG. 2 is a diagrammatic representation of one arrangement of load responsive pump controls.
Figure 4:
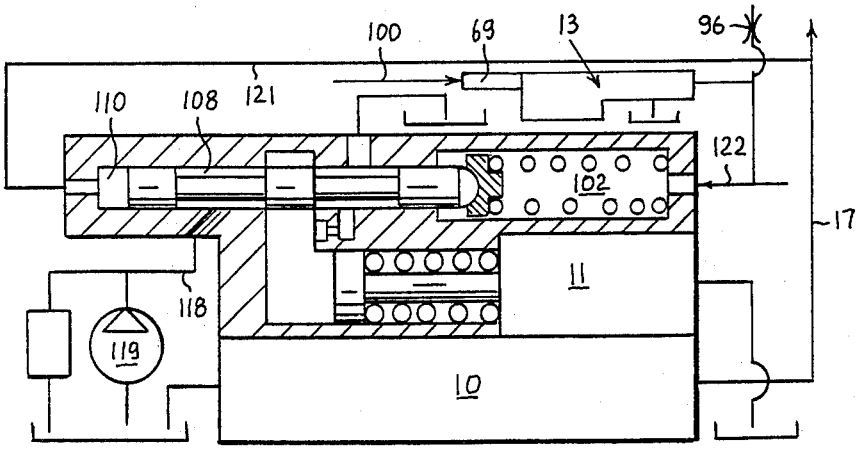
FIG. 4 is a diagrammatic representation of still another arrangement of load responsive pump controls.

Referring now to FIG. 2 the variable output flow pump 10 of FIG. 1 is provided with the flow changing mechanism 11 and the output flow control 12. First pressure control signal is transmitted from discharge line 20, through fixed or variable orifice 96, line 97, the differential control 13 and line 98 to the output flow control 12. A second pressure control signal 101 is transmitted directly from the largest system load to control space 102 of the output flow control 12. The output flow control 12, well known in the art, comprises a pilot valve 103, guided in a bore 104 and equipped with lands 105, 106 and 107, defining annular spaces 108, 109 and space 110. The pilot valve 103 is biased by a control spring 111, contained within control space 102. Bore 104 is provided with an exhaust core 112, connected to the system reservoir 19 and a control core 113, connected to a chamber 114 and through leakage orifice 115 also connected to the exhaust core 112. The chamber 114 contains a piston 116 operating the flow changing mechanism 11 and biased by a spring 117. Annular space 108 is connected by line 118 with discharge pressure of the pump 119 and the flow changing mechanism 11 is connected by line 120 with the system reservoir 19. In FIG. 1 the differential control 13 is connected to control space 102 as shown in FIG. 4. The arrangement of FIG. 2 shows the differential control 13 connected to a line transmitting pump discharge pressure control signal to the flow control 12.

Figure 3:
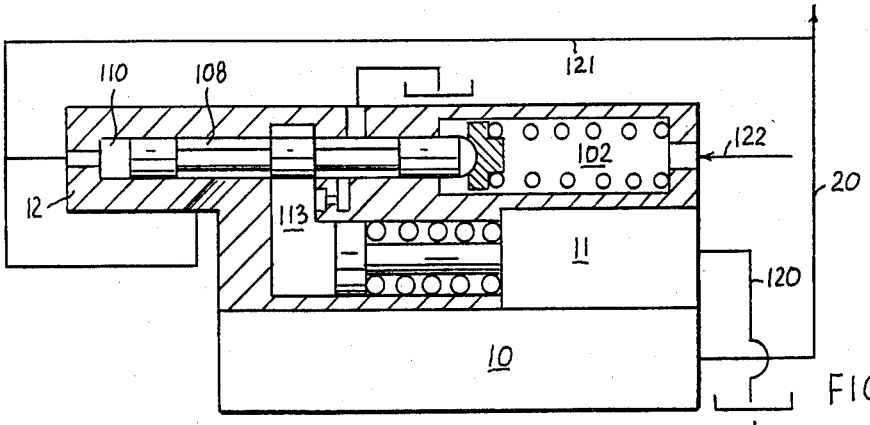
FIG. 3 is a diagrammatic representation of another arrangement of load responsive pump controls.

Referring now to FIG. 3 the basic arrangements of the flow changing mechanism 11 and the output flow control 12 of the fluid pump 10 are the same, as those shown in FIG. 2, however the output flow control 12 of FIG. 3 responds to different pressure control signals. Space 110 is directly connected by line 121 with the discharge line 20 and control space 102 is subjected to control pressure signal 122, which is a load pressure signal modified by the differential control 13.

Referring now to FIG. 4, in FIG. 4 the basic arrangement of FIG. 3 is shown with the fluid energy for pump controls being supplied to annular space 108 from separate pump 119, instead of using energy supplied by the pump 10. FIG. 3 shows the pump controls connected into basic system as shown in FIG. 1.

Figure 5:
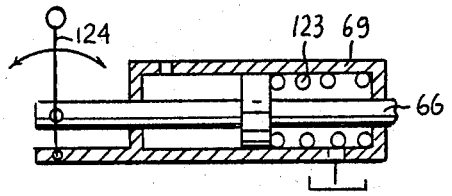
FIG. 5 is a diagrammatic representation of manual control input into load responsive controls of FIG. 1.

Referring now to FIG. 5, the stem 66 of the actuator 69 of FIG. 1 is biased by a spring 123 towards position of zero orifice and is directly operated by a lever 124, which provides the external signal **68*a***.

Figure 6:
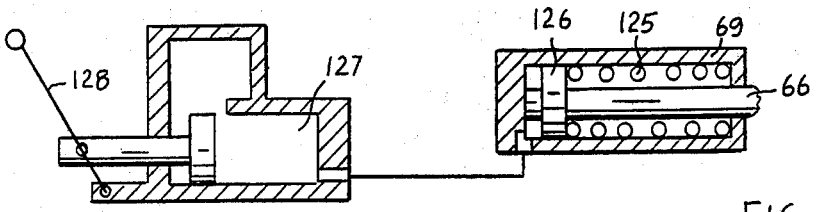
FIG. 6 is a diagrammatic representation of hydraulic control input into load responsive controls of FIG. 1.

Referring now to FIG. 6, the stem 66 of the actuator 69 of FIG. 1 is biased by a spring 125 towards position of zero orifice and is directly operated by a piston 126. Fluid pressure is supplied to the piston 126 from a pressure generator 127, operated by a lever 128.

Figure 7:
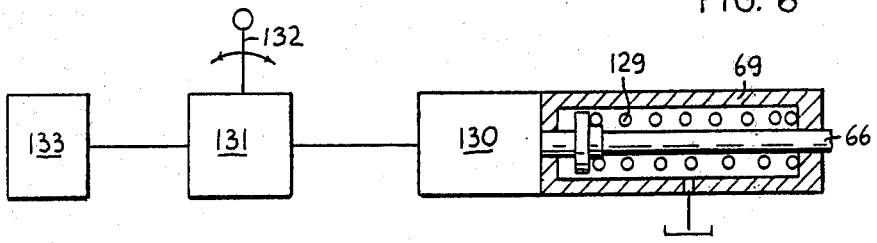
FIG. 7 is a diagrammatic representation of electromechanical control input into load responsive controls of FIG. 1.

Referring now to FIG. 7, the stem 66 of the actuator 69 of FIG. 1 is biased by a spring 129 towards position of zero orifice and is directly operated by a solenoid 130, connected by line to an input current control 131, operated by a lever 132 and supplied from an electrical supply source 133.

Figure 8:
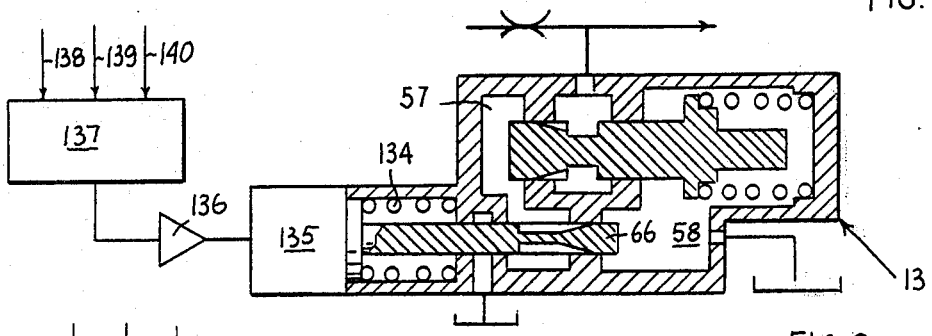
FIG. 8 is a diagrammatic representation of electrohydraulic control input into load responsive controls of FIG. 1.

Referring now to FIG. 8, the stem 66 of the differential control, generally designated as 13, is biased by a spring 134 towards a position, where it isolates the third control chamber 57 from the exhaust chamber 58 and is controlled by a solenoid or a stepping motor 135. The electrical control signal, amplified by amplifier 136, is transmitted from a logic circuit or a microprocessor 137, subjected to inputs 138, 139 and 140.

Figure 9:
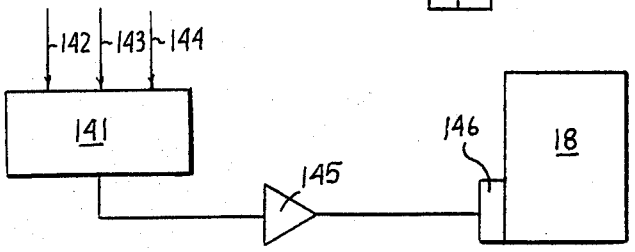
FIG. 9 is a diagrammatic representation of an electromechanical control input into load responsive system of FIGS. 1 and 8 using digital type signal.

Referring now to FIG. 9 a logic circuit or a microprocessor 141, supplied with control signals 142, 143 and 144, transmits an external digital control signal to a stepping motor 146 of the differential throttling valve 18 through an amplifier.

Referring now to FIG. 1 the hydraulic system shown therein comprises the fluid pump 10, equipped with the flow changing mechanism 11, operated by the output flow control 12. The output flow control 12 regulates delivery of the pump 10 into the load responsive circuit, composed of the differential control 13, regulating the level of pressure differential across the four way valve assembly 14, interposed between the pump 10 and the fluid motor 15 and a load responsive valve 16, interposed between the pump 10 and the fluid motor 17. The load responsive circuit of FIG. 1 also includes the differential throttling control 18, which throttles the fluid flow from the pump 10 to the four way valve assembly 14, to regulate the level of pressure differential developed across the four way valve assembly 14. The pump 10 may be of a fixed or variable displacement type and may respond to an external or internal control signal. With the pump 10 being of fixed displacement type, the output flow control 12, in a well known manner, regulates, through flow changing mechanism 11, delivery from the pump to the load responsive circuit, by bypassing part of the pump flow to the system reservoir 19. With the pump 10 being of variable displacement type the output flow control 12, in a well known manner, regulates through flow changing mechanism 11 delivery from the pump to the load responsive circuit by changing the pump displacement. Although in FIG. 1, for purposes of demonstration of the principle of the invention the differential control 13 is shown separated, in actual application the differential control 13 would be most likely an integral part of pump output flow control 12. The output flow control 12 may be supplied with fluid energy from the pump 10 through discharge line 20 and line 21, or from a separate source of fluid energy. The pressurized fluid from the pump 10 is connected through discharge line 20, differential throttling control 18, line 22, load check 23 and line 24 with the four way valve assembly 14 and through line 25, load check 26 and line 27 with the load responsive valve 16.

As previously stated the differential throttling control 18 is interposed between the pump 10 and the four way valve assembly 14 connected to the fluid motor 15 and controls the fluid flow and pressure therebetween. The differential throttling control 18 is composed of the throttling section 28 and the signal modifying section 29. The throttling section 28 with its throttling spool 36 throttles with throttling slots 40 fluid flow from the inlet chamber 31, connected by discharge line 20 to the pump 10, to the outlet chamber 32, connected by line 22, check valve 23 and line 24 with the load sensing ports 88 and 89 of of the four way valve assembly 14, to automatically maintain a constant pressure differential across the four way valve assembly 14. This control action is accomplished in the following way. Fluid from the outlet chamber 32 at $P_4$ pressure, which is the pressure acting upstream of the four way valve assembly 14, is transmitted through line 22, check valve 23 and line 24 to port 45*a* where, reacting on the cross-sectional area of the pilot valve spool 47, generates a force tending to move the pilot valve spool 47 upward to connect $P_4$ pressure through annular space 44 and passage 43 to the first control chamber 33 and therefore increase the pressure level in the first control chamber 33. Upon actuation of the four way valve assembly 14 fluid at load pressure Pw, which is the pressure acting down stream of the four way valve assembly 14, is transmitted through line 53 and orifice 52 to the second control chamber 46 where, reacting on the cross-sectional area of the pilot valve spool 47, it generates a force tending to move the pilot valve spool downward, to connect the reservoir pressure from annular space 50 to annular space 44, passage 43 and to the first control chamber 33 and therefore decrease the pressure level in the first control chamber 33. This force due to pressure in the second control chamber 46 is supplemented by the biasing force of the spring 51. Increase in pressure level in the first control chamber 33, above the level equivalent to preload of control spring 42, reacting on cross-sectional area of the throttling spool 36, will generate a force tending to move the throttling spool 36 from right to left, in the direction of closing of the flow area through the throttling slots 40 and therefore in direction of increasing the throttling action of the throttling spool 36. Conversely, a decrease in pressure level in the first control chamber 33, below level equivalent to preload of control spring 42, will result in the control spring 42 moving the throttling spool 36 from left to right, in the direction of increasing the flow area through the throttling slots 40 and therefore in direction of decreasing the throttling action of the throttling spool 36. Therefore by regulating pressure level in the first control chamber 33 the pilot valve spool 47 will control the throttling action of the throttling spool 36 and consequently the pressure drop between the inlet chamber 31 subjected to $P_1$ pressure and the outlet chamber 32 subjected to $P_4$ pressure. Assume that the stem 66 is in the position as shown in FIG. 1, isolating the third control chamber 57 from the exhaust chamber 58 and therefore making the signal modifying section 13 inactive. The pilot valve spool 47, subjected to $P_4$ and $P_3$ pressures and the biasing force of spring 51 will reach a modulating position, in which by throttling action of metering land 48 will regulate the pressure in the first control chamber 33 and therefore the throttling action of the throttling spool 36 to throttle the pump pressure $P_1$ to a level of $P_4$ pressure which is higher, by a constant pressure differential $\Delta P$, than $P_3$ pressure and equal to the quotient of the biasing force of spring 57 and the cross-sectional area of the pilot valve spool 47. In this way the pilot valve spool 47, subjected to low energy pressure signals, will act as an amplifying stage using the energy derived from the pump 10 to control the position and therefore the throttling action of the throttling spool 36. Leakage orifice 70, connecting the first control chamber 33 through passage 69*a* and the exhaust chamber 34 to the reservoir 19, is used, in a well known manner, to increase the stability of the pilot valve spool 47. Assume that the pressure differential acting across the actuated four way valve assembly 14 equals $\Delta Py$. If $P_3$ pressure is equal to Pw pressure which is the case when the stem 66 is in the position, as shown in FIG. 1, the throttling section 28, by throttling fluid flow from the inlet chamber 31 to the outlet chamber 32, will automatically maintain a constant pressure differential ΔP between the outlet chamber 32 and the second control chamber 46 and with ΔPy becoming ΔP, will also maintain a constant pressure differential across the four way valve assembly 14 which represents a variable orifice. With constant pressure differential, acting across an orifice, the flow through an orifice will be proportional to the area of the orifice and independent of pressure in the fluid motor. Therefore by varying the area of variable orifice of the four way valve assembly 14, the fluid flow to the fluid motor 15 and velocity of the load $W_1$ can be controlled, each specific area of variable orifice corresponding to a specific velocity of load $W_1$, which will remain constant, irrespective of the variation in the magnitude of the load $W_1$.

In the arrangement of FIG. 1 the relationship between load pressure Pw and signal pressure $P_3$ is controlled by the signal modifying section, generally designated as 29, and orifice 52. Assume that the stem 66, positioned by the actuator 69 in response to external digital or analog control signal 68*a*, as shown in FIG. 1, blocks completely metering orifice through metering slots 68, isolating the third control chamber 57 from the exhaust chamber 58. The control spool 59 with its land 60, protruding into the third control chamber 57, will generate pressure in the third control chamber 57, equivalent to the preload of the spring 64. Displacement of the stem 66 to the left will move metering slots 68 out of bore 67, creating an orifice area, through which fluid flow will take place from the third control chamber 57 to the exhaust chamber 58. The control spool 59, biased by the spring 64, will move from left to right, connecting by throttling slots 61 the supply chamber 55 with the third control chamber 57. Rising pressure in the third control chamber 57, reacting on cross-sectional area of control spool 59, will move back into a modulating position, in which sufficient flow of pressure fluid will be throttled from the supply chamber 55 to the third control chamber 57, to maintain the third control chamber 57 at a constant pressure, equivalent to preload in the spring 64. When displacing metering slots 68, in respect to bore 67, area of metering orifice between the third control chamber 57 and the exhaust chamber 58 will be varied. Since constant pressure differential is automatically maintained between the exhaust chamber 58 and the third control chamber 57 and therefore across the metering slots 68, by the control spool 59, each specific area of metering slots 68 will correspond to a specific constant flow level from the third control chamber 57 to the exhaust chamber 58 and from the supply chamber 55 to the third control chamber 57, irrespective of the magnitude of the pressure in the supply chamber 55. Therefore, each specific position of stem 66, within the zone of metering slots 68, will correspond to a specific flow level and therefore a specific pressure drop ΔPx through the fixed orifice 52, irrespective of the magnitude of the load pressure Pw. When referring to FIG. 1 it can be seen that $P_4-Pw=\Delta Py$, $P_4-P_3=\Delta P$, maintained constant by the throttling section 29 and $Pw-P_3=\Delta Px$. From the above equations when substituting and eliminating $P_3$, $P_4$ and Pw a basic relationship of $\Delta Py=\Delta P-\Delta Px$ is obtained. Since ΔPx can be varied and maintained constant at any level by the signal modifying section 29, so can ΔPy, acting across variable orifice of the four way valve assembly 14, be varied and maintained constant at any level. Therefore with any specific constant area of variable orifice, in response to external control signal 68*a*, pressure differential ΔPy can be varied from maximum to zero, each specific level of ΔPy being automatically controlled constant, irrespective of variation in the load pressure Pw. Therefore, for each specific area of variable orifice, created by displacement of four way valve assembly 14, the pressure differential, acting across variable orifice and the flow through variable orifice can be controlled from maximum to minimum by the signal modifying section 29, each flow level automatically being controlled constant by the differential throttling control 18, irrespective of the variation in the load pressure Pw. From inspection of the basic equation $\Delta Py=\Delta P-\Delta Px$ it becomes apparent that with $\Delta Px=0$, $\Delta Py=\Delta P$ and that the system will revert to the mode of operation of conventional load responsive system, with maximum constant ΔP of the differential throttling control 18. When $\Delta Px=\Delta P$, ΔPy becomes zero, outlet pressure from the differential throttling control 18 $P_4$ will be equal to load pressure Pw and the flow through variable orifice will become zero. With ΔPx larger than ΔP, pressure $P_4$ will become smaller than load pressure Pw and the load check 23 will seat.

In the load responsive system of FIG. 1 for each specific value of ΔPy, maintained constant by the signal modifying section 29 through the throttling section 28 of the differential control 18, the area of variable orifice can be varied, each area corresponding to a specific constant flow into the fluid motor 15, irrespective of the variation in the magnitude in the load pressure Pw. Conversely, for each specific area of the variable orifice pressure differential ΔPy, acting across variable orifice, can be varied by the signal modifying section 29, through the throttling section 28 of the differential throttling control 18, each specific pressure differential ΔPy corresponding to a specific constant flow into the fluid motor 15, irrespective of the variation in the magnitude of the load pressure Pw. Therefore fluid flow into fluid motor 15 can be controlled either by variation in the area of variable orifice created by actuation of the four way valve assembly 14, or by variation in pressure differential ΔPy, each of those control methods displaying identical control characteristics and controlling flow, which is independent of the magnitude of the load pressure. Action of one control can be superimposed on the action of the other, providing a unique system, in which, for example, a command signal from the operator, through the use of variable orifice, created by actuation of the four way valve assembly 14, can be corrected by signal 68*a* from a computing device, acting through the signal modifying section 18.

When actuating at the same time the four way valve assembly 14 and the load responsive valve 16, in a well known manner, only the higher of two load pressure signals will be transmitted through the check valve logic system and system fluid conducting lines to the flow control 12, regulating through the flow changing mechanism 11 the output flow of the system pump 10. This load pressure signal is modified by fixed orifice 96 and the differential control 13. The differential control 13 is composed of identical components and performs in an identical way as the signal modifying section 29 of the differential throttling control 18. The pressure differential ΔPx, acting across orifice 96, is controlled by the differential control 13, in a manner as previously described when referring to operation of the signal modifying section 29, in response to an external control signal 100, which may be of a digital or of an analog type. In turn the control of ΔPx, through the flow control 12, the operation of which will be described in detail when referring to FIGS. 2, 3 and 4, will modify ΔPy, acting across control valve operating highest of the system loads, so that the basic relationship of the control system of $\Delta Py = \Delta P - \Delta Px$ is always maintained. Therefore the differential control 13, in response to an external control signal 100, will regulate the pressure differential, across the load responsive valve controlling the highest system load and the pump flow control 12 will maintain it constant at any selected level. From inspection of the basic equation $\Delta Py = \Delta P - \Delta Px$ it becomes apparent that with $\Delta Px = 0$, $\Delta Py = \Delta P$ and that the system will revert to the mode of operation of conventional load responsive system, with maximum constant ΔP of the output flow control 12. When $\Delta Px = \Delta P$, ΔPy becomes zero, pump discharge pressure $P_1$ will be equal to maximum load pressure Pw and the flow through the load responsive valve controlling maximum load will become zero. With ΔPx larger than ΔP pump pressure $P_1$ will become smaller than load pressure Pw and the load check 23 or 26 will seat. With differential control 13 placed in line 21, conducting pump pressure signal to pump output flow control 12, the equation, defining the system performance will become $\Delta Py = \Delta P + \Delta Px$. In such a system, which will be described when referring to FIG. 2, the differential control 13 will regulate the system pressure differential from a minimum level equal to ΔP, to any desired maximum value.

In the load responsive system of FIG. 1, for each specific value to ΔPy, maintained constant by the differential control 13 through the output flow control 12, the area of variable orifice developed through the four way valve assembly 14 can be varied, each area corresponding to a specific constant flow into the fluid motor 15, irrespective of the variation in the magnitude in the load pressure Pw. Conversely, for each specific area of the variable orifice pressure differential ΔPy, acting across variable orifice, can be varied by the differential control 13 through the output flow control 12, each specific pressure differential ΔPy corresponding to a specific constant flow into the fluid motor 15, irrespective of the variation in the magnitude of the load pressure Pw. Therefore fluid flow into fluid motor 15 can be controlled either by variation in the area of variable orifice developed through the four way valve 14, or by variation in pressure differential ΔPy, each of those control methods displaying identical control characteristics and controlling flow, which is independent of the magnitude of the load pressure. Action of one control can be superimposed upon the action of the other, providing a unique system, in which, for example, as previously described, a command signal from the operator, through the use of variable orifice, can be corrected by signal 100 from a computing device, acting through the differential control 13.

Referring now back to FIG. 1, the differential control 13 and specifically the supply chamber 55 are connected through orifice 96, line 92, check valve 91, line 90 with the load sensing ports 88 and 89 of four way valve assembly, generally designated as 14. With the valve spool 78 in its neutral position, as shown in FIG. 1, load pressure sensing ports 88 and 89 are blocked by the land 80 and therefore effectively isolated from load pressure existing in load chamber 73 or 74. Under those conditions, in a well known manner, the differential throttling control 13, automatically maintains minimum pressure in the supply chamber 55 and equal to ΔP of the flow control 12. Displacement of the valve spool 78 from its neutral position in either direction, first connects with signal slot 86 or 87 load chamber 73 or 74 with load pressure sensing port 88 or 89, while load chambers 73 and 74 are still isolated by the valve spool 78 from the supply chamber 72 and exhaust chambers 75 and 76. Then the load pressure signal is transmitted through load pressure sensing port 88 or 89, line 90, check valve 91, line 92 and orifice 96 to the supply chamber 55, permitting the differential control 13 to react, before metering orifice is open to the load chamber 73 or 74. Further displacement of valve spool 78, in either direction, will create, in a well known manner, through metering slot 82 or 85 a metering orifice between one of the load chambers and the supply chamber 72, while connecting the other load chamber, through metering slot 84 or 85 with the exhaust chambers, in turn connected to system reservoir. The metering orifice can be varied by displacement of valve spool 78, each position corresponding to a specific flow level into one of the load chambers, irrespective of the magnitude of the load controlled by four way valve assembly 14. Upon this control, in a manner as previously described when referring to FIG. 1, can be superimposed the control action of the differential control 13. With valve spool 78 displaced to any specific position, corresponding to any specific area of metering orifice, the flow into load chambers can be proportionally controlled by the differential control 13, each value of pressure differential ΔPy being automatically maintained at a constant level by the pump flow control 12 and corresponding to a specific flow level into load chambers irrespective of the magnitude of the load controlled by the four way valve assembly 14.

Referring now to FIG. 2, a load responsive output flow control of a pump is shown. If the pump 10 is of a fixed displacement type, the flow changing mechanism 11 becomes a differential pressure relief valve, well known in the art. If the pump 10 is of a variable displacement type, the flow changing mechanism 11 becomes a differential pressure compensator, well known in the art. The pilot valve 103 on one side is subjected to a load pressure signal 101, together with the biasing force of control spring 111 and on the other side to pump discharge pressure signal which, as previously discussed when referring to FIG. 1, can be modified by the differential control 13. Subjected to those forces, in a well known manner, the pilot valve 103 will reach a modulating position, in which it will control the position of piston 116, to regulate the discharge pressure in discharge line 20, to maintain a constant pressure differential between pressure in space 110 and pressure in control space 102. This constant pressure differential is dictated by the preload in the control spring 111 and is equal to the quotient of this preload and cross-sectional area of the pilot valve 103. The pilot valve 103, in control of flow changing mechanism 11, uses energy supplied by the pump 119 through line 118.

Referring now to FIG. 3, space 110 is directly supplied from discharge line 20, while the flow changing mechanism 11 uses energy supplied from the pump 10. In conventional control of load responsive system pressure signal 122 is directly supplied from the system load and a small leakage is provided from control core 113. In the load responsive system of this invention load pressure signal is modified by the differential control 13.

Referring now to FIG. 4, the pump control of FIG. 3 is identical to that as shown in FIG. 2, but uses energy supplied from the pump 119. FIG. 4 shows the pump controls connected into a basic system as shown in FIG. 1. The differential control 13 is connected to space 102 and as described when referring to FIG. 1 modifies the control signal to vary the effective pressure differential across an orifice connecting the pump 10 and the load. As previously described in FIG. 1, the differential control 13 is shown separately connected to the schematically shown output flow control of the pump. As shown in FIG. 4 the components of the differential control 13 would become an integral part of the output flow control of the pump 10.

Referring now to FIG. 5, the stem 66 of the actuator 69 of FIG. 1 is biased by a spring 123 towards position of zero orifice and is directly operated by a lever 124, which provides the external signal 68 or 100 in the form of manual input.

Referring now to FIG. 6, the stem 66 of the actuator 69 of FIG. 1, biased by a spring 125 towards position of zero orifice and is directly operated by a piston 126. Fluid pressure is supplied, in a well known manner, to the piston 126 from a pressure generator 127, operated by a lever 128. Therefore the arrangement of FIG. 6 provides the external signal 68*a* or 100 in the form of a fluid pressure signal.

Referring now to FIG. 7, the stem 66 of the actuator 69 of FIG. 1 is biased by a spring 129 towards position of zero orifice and is directly operated, in a well known manner, by a solenoid 130, connected by a line to an input current control 131, operated by a lever 132 and supplied from an electrical power source 133. Therefore the arrangement of FIG. 7 provides the external signal 68*a* or 100 in the form of an electric current, proportional to displacement of lever 132.

Referring now to FIG. 8, the stem 66 of the differential control 13 is biased by a spring 134 towards position, where it isolates the inlet chamber 57 from the exhaust chamber 58. The stem 66 is completely pressure balanced, can be made to operate through a very small stroke and controls such low flows, at such low pressures, that the influence of flow forces is negligible. The stem 66 is directly coupled to a solenoid 135. The position of solenoid armature, when biased by a spring, is a function of the input current. For each specific current level there is a corresponding particular position, which the solenoid will attain. As the current is varied from zero to maximum rating, the armature will move one way from a fully retracted to a fully extended position in a predictable fashion, depending on the specific level of current at any one instant. Since the forces developed by solenoid 135 are very small, so is the input current which is controlled by a logic circuit of a micro-processor 137. The micro-processor 137 will then, in response to different types of transducers, either directly control the system load, in respect to speed, force and position, or can superimpose its action upon the control function of an operator, to perform the required work in minimum time, with a minimum amount of energy, within the maximum capability of the structure of the machine and within the envelope of its horsepower.

Referring now to FIG. 9, the control signal from the logic circuit, or the micro-processor 141, which may be of a digital or analog type, is transmitted through an actuator and positions the stem 66 of the differential valve 13 of FIG. 8. If the control signal from the micro-processor 141 is of a digital type the actuator will most likely be the stepping motor 146, provided with a lead screw, well known in the art, which will directly position the stem 66 in response to a digital control signal, dispensing with the need for a digital to analog converter.

As previously described the stem 66 is completely balanced from the force standpoint and requires minimal power levels for its actuator. Therefore with the digital control signal a low power stepping motor with a lead screw can provide simple reliable and inexpensive interface hardware between the valve controls and the electronic circuit.

Although the preferred embodiments of this invention have been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. A load responsive fluid control system comprising a fluid pump having an output flow control and an outlet, a fluid motor subjected to load pressure, exhaust means, and a direction control valve interposed between said outlet of said pump, said fluid motor and said exhaust means, said direction control valve having first valve means for selectively interconnecting said fluid motor with said pump and said exhaust means and for providing variable orifice means between said outlet of said pump and said fluid motor, load pressure sensing port means in said direction control valve selectively communicable with said fluid motor and with duct means connected to said output flow control of said pump, second valve means responsive to pressure in said load pressure sensing port means in said direction control valve having control means and fluid throttling means operable to throttle fluid flow from said fluid pump to said fluid motor to maintain a constant pressure differential at a preselected constant level across said control means of said second valve means and to maintain a constant pressure differential across said variable orifice means, third valve means having means operable through said fluid throttling means of said second valve means to vary level of said constant pressure differential across said variable orifice means while said pressure differential across said control means of said second valve means remains constant at said constant predetermined level, and fourth valve means operable through said output flow control of said pump to control the pressure differential between pressure in said pump outlet and pressure in said load pressure sensing port means.

2. A load responsive fluid control system as set forth in claim 1 wherein said first valve means has a neutral position in which it blocks said load sensing port means, said first valve means when displaced from said neutral position first connecting said load sensing port means with said fluid motor before connecting said pump to said fluid motor.

3. A load responsive fluid control system as set forth in claim 1 wherein said output flow control of said pump includes a bypass flow control means.

4. A load responsive fluid control system as set forth in claim 1 wherein said output flow control of said pump includes pump displacement changing means.

5. A load responsive fluid control system as set forth in claim 1 wherein said fourth valve means has control means to maintain a constant pressure differential between pressure in said pump outlet and pressure in said load sensing port means.

6. A load responsive fluid control system as set forth in claim 5 wherein said control means has means to vary pressure level of said constant pressure differential in response to an external control signal.

7. A load responsive fluid control system as set forth in claim 1 wherein said second valve means has amplifying pilot valve means.

8. A load responsive fluid control system as set forth in claim 1 wherein said third valve means has means responsive to an external control signal.

9. A load responsive fluid control system as set forth in claim 1 wherein direction phasing valve means is interposed in said duct means between said direction control valve and said output flow control of said fluid pump.

10. A load responsive fluid control system as set forth in claim 1 wherein load check valve means is interposed between said variable orifice means and said fluid throttling means.

11. A load responsive fluid control system as set forth in claim 1 wherein said duct means has first check valve means, second duct means for transmittal of control pressure signal from a direction control valve connected to said first duct means down stream of said first check valve means and second check valve means in said second duct means.

12. A load responsive fluid control system comprising a fluid pump having an output flow control and an outlet, a fluid motor subjected to load pressure, exhaust means, and a direction control valve interposed between said outlet of said pump, said fluid motor and said exhaust means, said direction control valve having first valve means for selectively interconnecting said fluid motor with said pump and said exhaust means and for providing variable orifice means between said outlet of said pump and said fluid motor, load pressure sensing port means in said direction control valve selectively communicable with said fluid motor and with duct means connected to said output flow control of said pump, second valve means responsive to pressure in said load pressure sensing port means in said direction control valve having control means including amplifying pilot valve means and fluid throttling means and operable to throttle fluid flow from said fluid pump to said fluid motor to maintain a constant pressure differential at a preselected constant level across said pilot valve means of said control means and to maintain a constant pressure differential across said variable orifice means.

13. A load responsive fluid control system as set forth in claim 12 wherein said first valve means has a neutral position in which it blocks said load sensing port means, said first valve means when displaced from said neutral position first connecting said load sensing port means with said fluid motor before connecting said pump to said fluid motor.

14. A load responsive fluid control system as set forth in claim 12 wherein said output flow control of said pump includes a bypass flow control means.

15. A load responsive fluid control system as set forth in claim 12 wherein said output flow control of said pump includes pump displacement changing means.

16. A load responsive fluid control system as set forth in claim 12 wherein said pilot valve amplifying means has first means responsive to pressure upstream of said variable orifice means and second means responsive to pressure down stream of said variable orifice means.

17. A load responsive fluid control system as set forth in claim 12 wherein said fluid throttling means has means responsive to pressure in a control chamber, said amplifying pilot valve means having means to control pressure in said control chamber.

18. A load responsive fluid control system as set forth in claim 12 wherein direction phasing valve means is interposed in said duct means between said direction control valve and said output flow control of said fluid pump.

19. A load responsive fluid control system as set forth in claim 12 wherein load check valve means is interposed between said variable orifice means and said fluid throttling means.

20. A load responsive fluid control system as set forth in claim 12 wherein said duct means has first check valve means, second duct means for transmittal of control pressure signal from a direction control valve connected to said first duct means down stream of said first check valve means and second check valve means in said second duct means.

* * * * *